US005174122A

United States Patent [19]

Levine

[11] Patent Number: 5,174,122

[45] Date of Patent: Dec. 29, 1992

[54] METHOD AND MEANS OF LOW TEMPERATURE TREATMENT OF ITEMS AND MATERIALS WITH CRYOGENIC LIQUID

[75] Inventor: Jeffrey Levine, Lexington, Mass.

[73] Assignee: Applied Cryogenics, Inc., Newton Upper Falls, Mass.

[21] Appl. No.: 415,983

[22] Filed: Oct. 2, 1989

[51] Int. Cl.[5] ..... F17C 9/02

[52] U.S. Cl. ..... 62/50.2; 62/51.1; 62/457.9

[58] Field of Search ..... 62/51.1, 50.2, 457.9

[56] References Cited

U.S. PATENT DOCUMENTS

| | | | |
|---|---|---|---|
| 3,354,668 | 11/1967 | Cserny | 62/457.9 |
| 3,411,318 | 11/1968 | Puckett | 62/457.9 |
| 3,512,370 | 5/1970 | Murphy et al. | 62/332 |
| 4,006,606 | 2/1977 | Underdue | 62/449 |
| 4,377,076 | 3/1983 | Staudt et al. | 62/457.9 |
| 4,485,641 | 12/1984 | Angelier et al. | 62/51.1 |
| 4,739,622 | 4/1988 | Smith | 62/457.9 |
| 4,783,969 | 11/1988 | Hohol | 62/51.1 |

*Primary Examiner*—Ronald C. Capossela
*Attorney, Agent, or Firm*—Robert T. Dunn

[57] ABSTRACT

A payload loaded into a chamber is cycled to a low temperature of about −320° F. using liquid nitrogen fed to a heat exchanger evaporator that is located at the top of the chamber so that gaseous nitrogen vapor from the evaporator, at substantially the same temperature as the liquid nitrogen, is circulated to a payload in the chamber below, and, at the same time, gas from the chamber is circulated upward to highly thermally conductive fins on the heat exchanger that are cooled by the liquid nitrogen evaporation. Thus, heat from the payload is fed from the gas circulating upward to the heat exchanger to evaporate the liquid nitrogen and so the payload located at the bottom of the chamber is cooled by gas kinetics and is never touched by the liquid nitrogen.

In a preferred embodiment, an electric heater element and a fan are provided between the heat exchanger and the chamber and the heater is controlled to modify temperature descent rate during a low temperature cycle and to heat the chamber up to about +300° F. for a high temperature cycle; and the heat exchanger, heater and fan are all carried by a (power) head that fits over and partially into the top of the chamber. Thus, the chamber may be a vacuum (envelope) chamber with no penetrations of the vacuum envelope to accommodate any of the elements, detectors or actuators and no cryogenic liquid inlet tubes penetrate the chamber.

18 Claims, 6 Drawing Sheets

METHOD AND MEANS OF LOW TEMPERATURE TREATMENT OF ITEMS AND MATERIALS WITH CRYOGENIC LIQUID

BACKGROUND OF THE INVENTION

The present invention relates to techniques of treating items and materials to low temperatures and more particularly, to such techniques that use cryogenic liquids, like liquid nitrogen, to chill items and materials to improve the abrasive wear resistance, corrosive wear resistance, erosive wear resistance and related physical characteristics of the items and materials including metals, metallic alloys, cemented carbides, plastics, ceramics, semiconductors and the like.

Low temperature treatment (−120° F. to −320° F.), or cryogenic processing of materials, particularly metals in the form of cutting tools, has been known to show some improvement in abrasion and corrosion resistance along with reduction of internal residual stresses and improved material stability. Thus, low temperature treatment of metal tools results in improvement in the wear resistance of such tools (increases tool life) whereas the heat treatment of metal tools is utilized to obtain desired combinations of metal hardness, toughness and ductility. With cryogenic processing there is minimal change in the dimension, size or volume of the items treated.

Conventional steel metallurgy is based on the transformation of steel from the relatively soft austenite crystalline state to the harder martensite crystalline state. By heating the steel, it is put into the austenite state and the subsequently rapidly cooling or quenching of the austenite to room temperature triggers a transformation to martensite. Long ago it was observed that more austenite is transformed to martensite if the steel is chilled to below room temperature and when chilled to very low temperature (−120° F. to −320° F.) using cryogenic techniques, the steel hardness and abrasive resistance are greatly improved.

One observer has suggested that merely reducing the few percent of austenite that is left after conventional quenching, by further low temperature chilling to about −300° F., cannot account for the improved hardness and abrasive resistance. That observer claimed that the low temperature chilling produces fine carbide particles that are distributed throughout the martensite and reduce internal stress in the martensite. This explanation may apply to steel and it may apply to some non-ferrous metals, however, it does not apply non-metallic and amorphous materials. For example, copper electrodes are improved by deep chilling to −300° F. and so are nylon violin strings and many other non-ferrous materials. Cryogenic processing has been used for improving the wear resistance of industrial cutting tools, dies, drills, end mills, gear cutters and hand tools such as knives, chisels, planes, saws, punches, files, etc. It has been used to improve durability of turbine blades, ball and roller bearings, piston rings and bushings, and improve the resilience of springs. It has been used to improve performance of resistance welding electrodes and the dimensional stability of castings and forgings. The materials treated have included: steel and steel alloys; titanium and titanium alloys; high-nickel alloys; copper and brass; aluminum and aluminum alloys; cemented carbides; ceramic materials; and a wide variety of plastic materials including nylons and teflons.

Ultralow temperature treatment has been carried out principally using liquid nitrogen as the cooling medium. Temperature descent from ambient temperature to cryogenic temperatures of −300° F. to −320° F. often takes many hours and sometimes several days. The parts, items or materials under treatment are maintained at the low temperature for many hours and then return to ambient temperature over an even greater period and the treatment results are frequently unpredictable and sometimes destructive.

Heretofore, apparatus for chilling small items like tools, electrodes, musical instrument strings, etc., has included a fully insulated box with a removable or hinged top and a payload platform (uniformly perforated) located a short distance above the inside bottom surface of the chamber. cryogenic liquid delivery pipe enters the treatment chamber a point near the top of one of the chamber's side walls and extends downwardly to a point near the bottom of the chamber. The delivery pipe has a liquid discharge port (or extends as a delivery manifold) below the parts platform and introduces the cryogenic liquid to the chamber. The processing cycles may include a sequence of modes of operation including: (a) descent of the payload items into the gas above the cryogenic liquid; (b) further descent into the gas closer to the surface of the liquid; (c) pre-soak for several hours with submersion of parts in the cryogenic liquid of up to 50% to 75% of the maximum cryogenic liquid level height; (d) soak for several more hours with submersion of parts in the cryogenic medium of up to 75% to 100% of the maximum cryogenic liquid level height; and (e) descend fully into the cryogenic liquid which is allowed to evaporate (boil off) until the chamber is free of such medium and the chamber temperature has reached ambient.

Some of the problems encountered with the prior apparatus described above arise as follows: (1) delivery of liquid nitrogen to the bottom of the chamber below the payload platform often splashes or splatters the liquid on the payload parts causing extreme thermal shock to the parts that are still relatively warm; (2) the coldest gas in the chamber is just above the liquid and the gas does not flow upward (rise) to the payload parts—the cold gas does not reach the parts until just about all of the gas in the chamber is cold and the coldest gas will always be below the payload parts; (3) pre-soaking the part partially submersed in the liquid nitrogen causes the part to chill unevenly, as the portion of the part that is submersed chills much faster than the portion that is not submersed; and (4) any submersion of the part in the liquid nitrogen results in boiling heat transfer from the part at an excessive rate that does not allow all portions of the part to cool evenly.

SUMMARY OF THE INVENTION

It is an object of the present invention to provide a method and means using cryogenic liquid of chilling items and materials of a payload wherein the above mentioned problems of prior techniques are avoided.

It is another object to provide apparatus for containing and treating a payload of parts, items and materials to cryogenic temperatures using a cryogenic liquid wherein the payload parts, items or materials are not contacted by the liquid.

It is another object to provide such apparatus having means for detecting the temperature of gas evaporated from the cryogenic liquid and controlling the gas temperature over a schedule of temperature versus time.

It is another object of the present invention to provide an improved treatment chamber for carrying out cryogenic temperature processing of parts and items to increase their wear resistivity with a high degree of predictability.

It is a further object of the invention to provide apparatus for effecting the cryogenic temperature treatment parts and items under optimum time-temperature profiles to achieve processing results with predictable repeatability.

It is an other object of the invention to provide an improved method for carrying out cryogenic temperature treatment of parts and items to increase the wear resistivity of such parts and items.

It is yet another object of the invention to provide an improved method for carrying out cryogenic temperature treatment of parts and items utilizing optimum time-temperature processing profiles to increase the wear resistivity and stability of such parts and items.

It is another object of certain features of the invention to provide a cryogenic liquid level detector without moving parts.

It is another object of the same features of the invention to provide a cryogenic liquid level overflow detector without moving parts.

It is another object of certain other features of the invention to provide a drive shaft seal at a wall through which the drive shaft passes from ambient surroundings so that the humid ambient air on the outside of the wall does not flow through the wall around the drive shaft and into the low temperature area.

An embodiment of the present invention described herein is used to automatically cycle a payload (parts, items and materials)) loaded into its chamber between temperatures of +300° F. and −320° F. using liquid nitrogen as the cryogenic liquid (medium). The payload temperature is reduced by cooling an internal heat exchanger that is located at the top of the chamber with a controlled flow of liquid nitrogen to an evaporation pan that is intimately thermally connected to the top of the heat exchanger, by the circulation of dry gaseous nitrogen that evaporates from the liquid nitrogen contained in pan. A fan located between the top of the chamber, the heat exchanger and an electric heating element level with or just below the fan are all carried by the power head that fits over and partially into the top of the chamber and so the payload located at the bottom of the chamber is cooled by gas kinetics and is never touched by the liquid nitrogen The liquid nitrogen level in the pan is detected and controlled to maintain the level so that it never exceeds a predetermined maximum level throughout the treatment cycles. For this purpose a thermally responsive electrical resistor is located at the desired maximum level of the liquid and the resistance of that resistor is monitored. When the level falls below the resistor, its resistance changes abruptly and that change is detected to initiate a flow of liquid nitrogen to the pan.

The fan drive is from a motor outside of the power head and so the motor drive shaft must extend through the heat exchanger and other parts of the head. The opening for the drive shaft from the outside into the power head is sealed against leakage of ambient air into the power head using a special packing mixture of grease containing long fibers that prevent the grease from migrating away from the shaft.

Other objects and advantages of the invention will be apparent from the following detailed description of the invention, taken with the accompanying drawings.

DESCRIPTION OF EMBODIMENTS OF THE INVENTION

Figure 1:
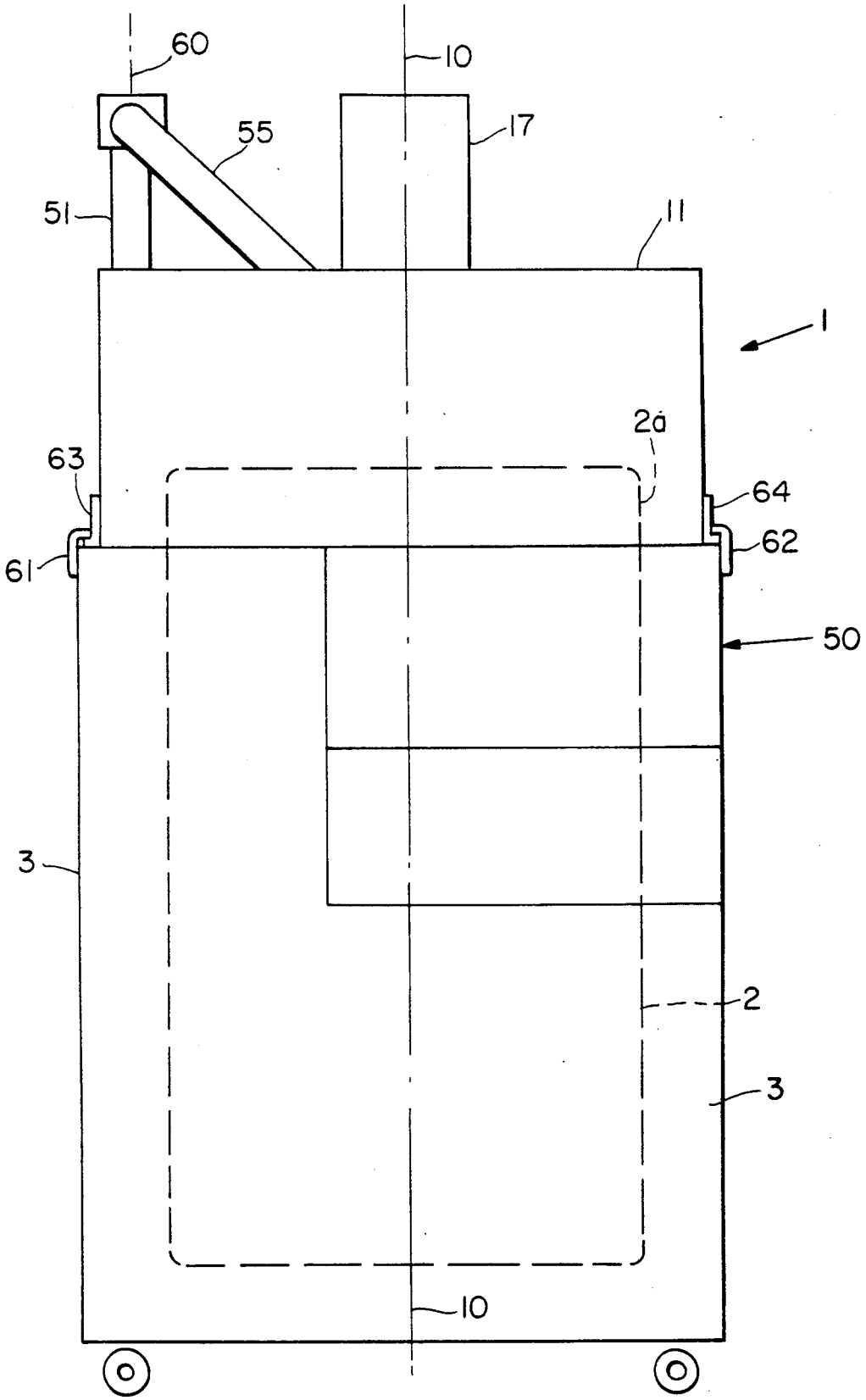
FIG. 1 is a front view of cryogenic temperature treatment apparatus incorporating all features of the present invention for carrying out cryogenic temperature processing of payload parts, items and materials in accordance with the method of the invention.

An embodiment of the present invention incorporating all of the features and improvements of the invention is shown in FIG. 1 and is referred to herein as a "Cryoprocessor". It is capable of automatically cycling a payload (parts, items and materials)) loaded into its chamber, between a high temperature of +300° F. and a low temperature of −320° F. using an electric heater to reach the high temperature and liquid nitrogen as the cryogenic liquid (medium) to reach the low temperature. The payload temperature is reduced by cooling an internal heat exchanger that is located at the top of the chamber in the chamber cover or lid (herein called the power head) Low temperature is achieved with a controlled flow of liquid nitrogen to the heat exchanger in the power head, while a fan circulates dry gaseous nitrogen that evaporates from the liquid nitrogen contained in the head. The fan is located between the top of the chamber and the heat exchanger and an electric heating element, also carried by the power head is level with or just below the fan. Thus, the cryogenic liquid heat exchanger, the electric heater and the fan are all carried by the power head that fits over and partially into the top of the chamber, and the payload located at the bottom of the chamber is cooled by gas kinetics and the payload is never touched by the liquid nitrogen.

Figure 2:
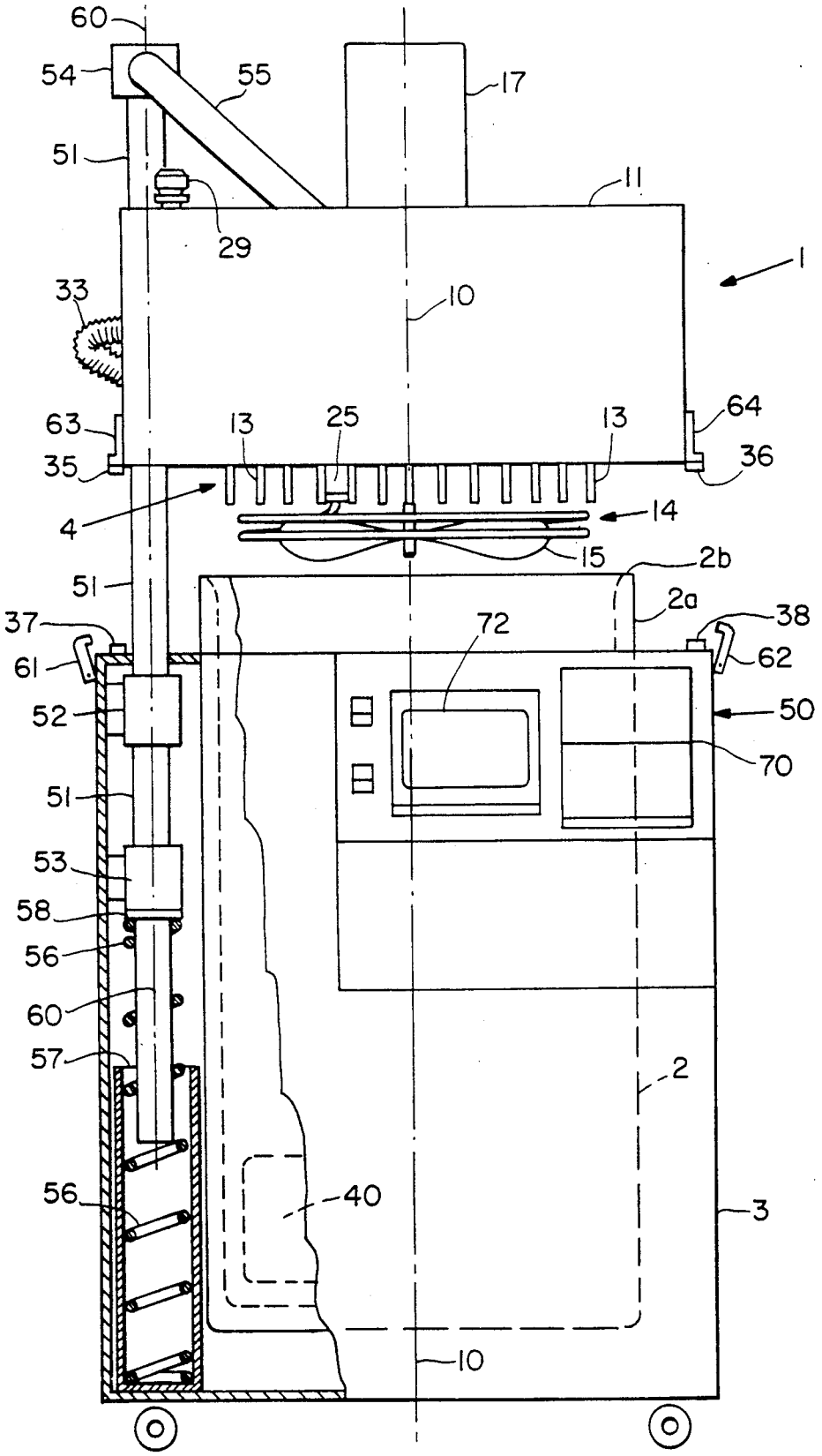
FIG. 2 is a front, partially cross section, view of the cryogenic temperature treatment apparatus of FIG. 1 with the power head thereof lifted and the chamber housing partially sectioned revealing details of the power head lift assembly.
Figure 3:
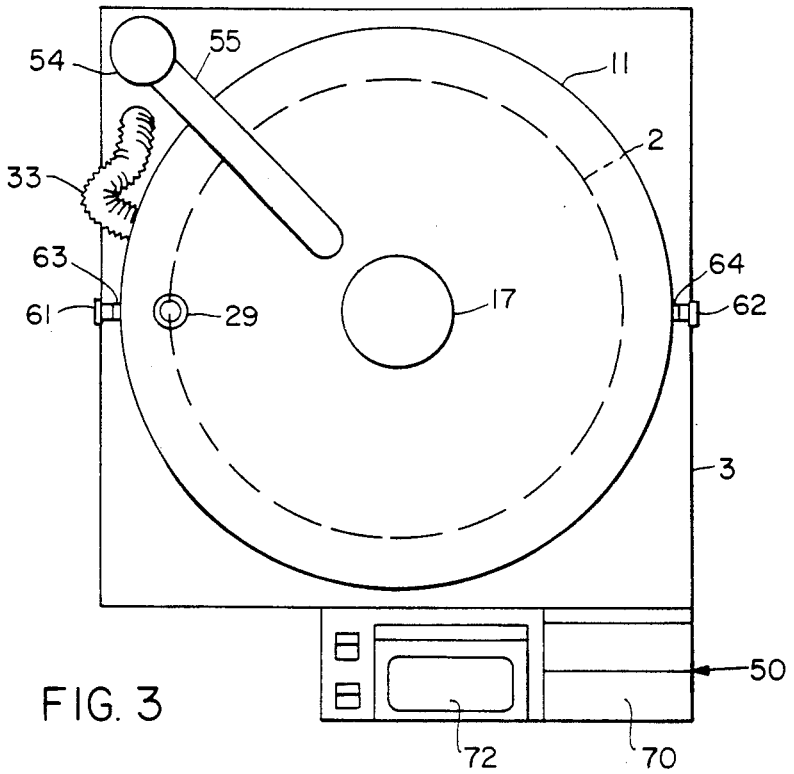
FIG. 3 is a top view of the apparatus with the power head clamped to the top of the chamber housing.

As shown in FIGS. 1 and 2, the power head 1 carries at the bottom thereof, fan 15 to provide convective flow of cold nitrogen gas flowing around the fins 13 of aluminum heat exchanger 4 projecting from the power head above, down into the "Dewar" chamber 2 that is contained within chamber housing 3 FIG. 1 shows the power head 1 clamped securely over the vacuum insulated "Dewar" chamber 2 and provides a means of producing the prescribed temperature changes within the chamber. A solenoid valve inside the head permits liquid nitrogen from a source outside of the apparatus to flow into the upper portion of the heat exchanger which is in the form of a shallow pan. The liquid nitrogen in the pan cools the pan and the attached fins. The rotating fan blades 15 provide a continuous flow of gas over the fins. Heat is transferred from the chamber and payload to the heat exchanger fins by this convective flow. Thus, liquid nitrogen contacts only the upper portion of the heat exchanger. The vacuum insulated chamber 2 may be generally cylindrical in shape and is preferably upstanding as shown and so defines a vertical axis 10 of the apparatus.

Figure 5:
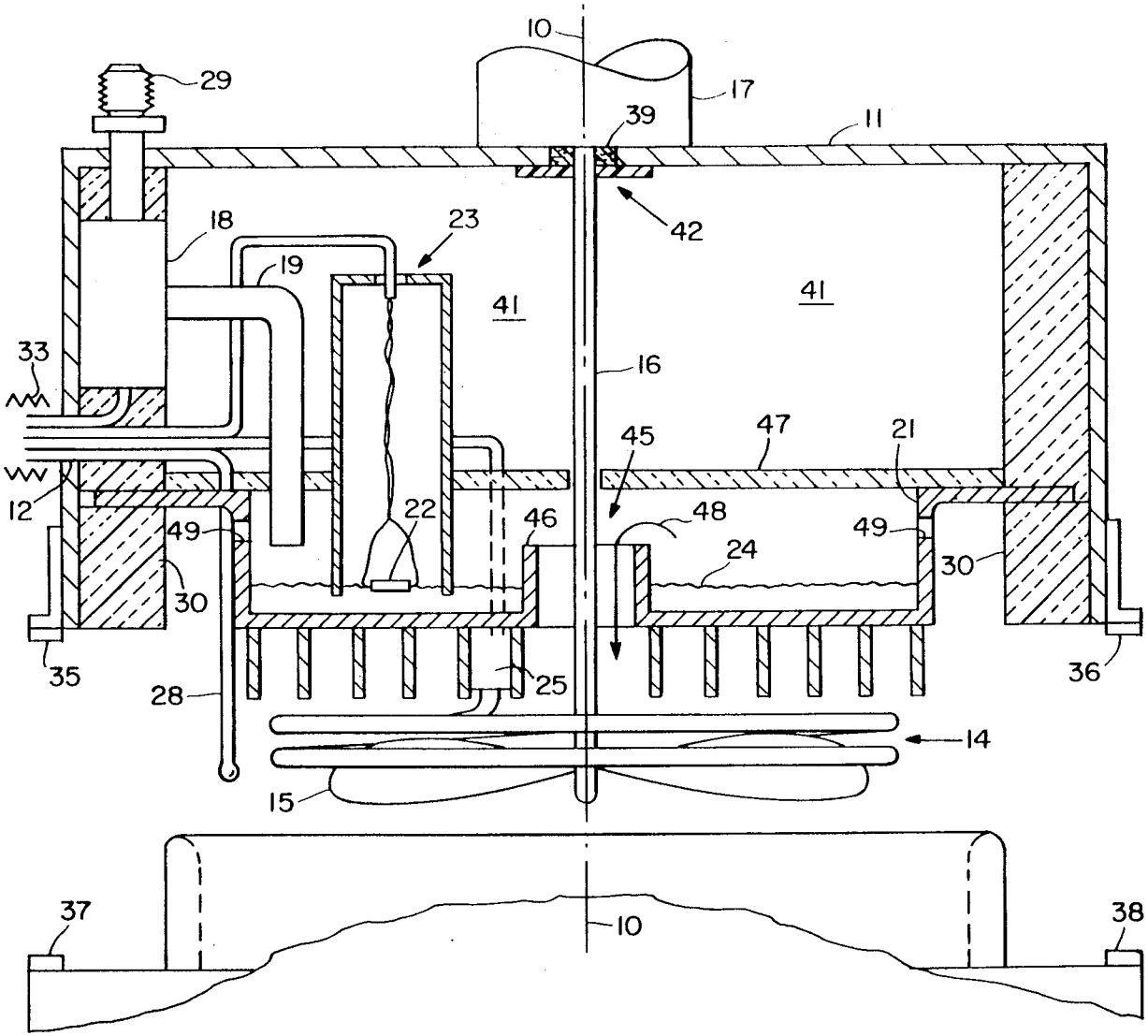
FIG. 5 is an enlarged cross section view of the power head showing details thereof.

The inside of power head 1 is shown in FIG. 5. Within the power head housing 11 are electric resistance heating element 14, thermocouple temperature sensor 28, high temperature limit switch 25 (for the element 14), solenoid valve 18 suitable for cryogenic liquids, liquid nitrogen level sensing element 22 enclosed in shield 23, felt gaskets 30, and long fiber grease seal 42 around motor shaft 16 at the top where it enters the power head and on the outside of the power head housing 11, at the top, is mounted the fan drive motor 17 and the liquid nitrogen inlet fitting 29. Electric cables for the solenoid valve 18, high temperature limit switch 25, level sensing resistor element 22 and thermocouple 28 all pass through opening 12 in the side of the head enclosure to flexible conduit 33 that carries the cables down to the control system 50. On the outside of the power head housing 11 at the bottom are permanent magnets 35 and 36 used to activate proximity switches 37 and 38 on the top of chamber housing 3.

At the beginning of operation the power head is clamped securely over the vacuum insulated "Dewar" chamber and a command for cooling initiated at the controller 50 results in solenoid valve 18 permitting liquid nitrogen to flow through tube 19 into pan 21 (the upper portion of heat exchanger 4). The liquid nitrogen 24 in the pan boils, cooling the pan and the heat exchanger fins 13. The fan 15 forces a continuous flow of dry nitrogen gas over the fins and down into chamber 2. Thus, heat is transferred from the chamber and payload 40 at the bottom of the chamber to the heat exchanger fins by this convective flow.

The small permanent magnets 35 and 36 are mounted on the power head so that when the head is in the closed position shown in FIG. 1, the magnetic proximity switches 37 and 38 on the chamber housing 3 are closed. When these switches are closed, operation of fan 13 and electric heater 14 is permitted. Conversely, when the head is opened, as shown in FIG. 2, the fan and heater are deactivated.

A felt gasket 30 is provided to form a snug seal around the top of the vacuum Dewar chamber 2, against the portion 2*a* of the chamber projecting from the top of housing 3, when the head is in the closed position shown in FIG. 1. This seal inhibits the infiltration of water vapor from the ambient atmosphere (which could cause rusting of the payload) while allowing gaseous nitrogen evolved during cooling to be vented. Care is exercised in the construction of the head to ensure a vapor tight seal at all mating surfaces which communicate with the ambient environment and the interior of the head.

Fan Drive Shaft Seal

Figure 6:
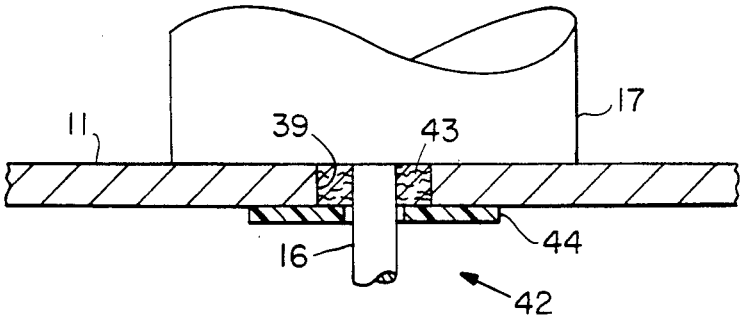
FIG. 6 are much enlarged views of the fan drive shaft seal at the top of the power head.

The fan drive is from motor 17 on top of the head and so the motor drive shaft 16 must extend through the head housing 11 and through heat exchanger 4 and other parts of the head to the fan 15. The opening 39 at the top communicates with the outside ambient air and so must be sealed to prevent outside air from entering the system and bringing moisture with it. Hence, opening 39 is sealed using a special packing mixture of long fibers and grease as shown in FIG. 6. This seal is required to prevent infiltration of water vapor, which can degrade the effectiveness of the fiberglass insulation 41 in the head and cause a build up of ice around the rotating motor shaft 16 with the possibility of consequent seizure of the motor.

Hence, as shown in FIG. 6, the opening 39 is sealed at the point of penetration of motor shaft 16 by means of a packing gland 42 filled with long fiber grease 43, retained by plate 44, to permit free rotation of the shaft while excluding water infiltration.

Fan drive shaft 16 passes through heat exchanger 4 at opening 45, which is defined by the upward projecting center portion 46 of the pan and a cover 47 overlays the pan so that gaseous vapor from the pan flows as shown by arrow 48 and through openings 49 in the sides of the pan, downward past heater 14 into the top of chamber 2.

The cryogenic apparatus described, with all active cooling and heating elements contained and the fan and all detectors and controlled actuators in the power head 1, permits the use of a vacuum dewar chamber 2 with no penetrations of the vacuum envelope to accommodate any of those elements detectors or actuators and no cryogenic liquid inlet tubes that penetrate the chamber. This ensures maximum thermal insulating value from the vacuum insulation and also minimizes thermal gradients within the chamber.

Power Head Lift and Orientation Mechanism

As shown in FIG. 1, the power head 1 is raised and oriented by means of a spring loaded, ground steel shaft 51, which is guided by linear ball bearings 52 and 53 mounted to the chamber enclosure 3. The power head is carried by shaft 51, cantilevered therefrom, by structure including shaft end cap 54 and rigid support rod 55. A spring 56 contained in tube 57 and surrounding the lower portion of the shaft is compressed to, at all times, exert an upward force on the shaft on the shaft stop ring 58 that is attached to the shaft. The upward force so exerted on shaft 51 is slightly greater than the combined weights of the power head and the shaft and other components affixed to the shaft. Therefore, when unrestrained, power head 1 will automatically rise to its fully raised position as shown in FIG. 2. It can be easily closed by minimal downward, manual force and secured in the closed position by two toggle clamps 61 and 62 mounted to the chamber housing 3 which engage brackets 63 and 64 protruding from the vertical surface of the head.

The linear bearings 52 and 53 permit the rotation of the shaft and the attached head around the vertical axis 60 of the shaft when the head is in the open position. By so swinging the head out of the way, the operator has free access to the top of the chamber for the purpose of loading and unloading the payload.

As mentioned above, all electrical connections to the head are made via wires bundled in a protective, flexible conduit 33 which is long enough to accommodate the vertical motion of the head, and sufficiently flexible to accommodate the rotation of the head

Vacuum Insulated Chamber

The vacuum insulated chamber 2 which holds the payload 40 is a vacuum "Dewar". It is a cylindrical .double walled stainless steel vessel. The two walls meet at the lip *2a* which defines the mouth of the chamber that projects upward from the top of housing 3. The space between the walls is filled with windings of aluminized mylar and this space is evacuated to approximately $10^{-6}$ torr The aluminized mylar windings in vacuum provide for extremely efficient thermal insulation in approximately one inch thickness. This insulation makes possible energy efficient operation of the device and also minimizes thermal gradients within the chamber.

The inner surfaces of chamber 2 may be protected from damage and possible accidental penetration by means of expendable galvanized steel and aluminum inserts (not shown).

Cryogenic Liquid Level Sensor

The liquid nitrogen level in the pan is detected and controlled to insure a maximum level throughout treatment cycles and to prevent overflow of the pan. For this purpose thermally responsive electrical resistor 22 is located at the desired level of the liquid nitrogen 24 in the pan and the resistance of that resistor is monitored. When the level falls below the resistor, its resistance changes abruptly and the change increase is detected to initiate a flow of liquid nitrogen to the pan. Similarly, when the level then rises above resistor 22, its resistance changes abruptly in the opposite direction and the flow of liquid nitrogen to the pan stops, preventing overflow.

The liquid nitrogen level sensor makes use of the temperature dependence of resistance of a carbon composition resistor and the difference in the rate of heat loss for a resistor surrounded by gaseous nitrogen at a given temperature and the same resistor surrounded by liquid nitrogen at the same given temperature. The sensing resistor 22 is biased to run near its maximum safe current. It may be electrically connected in circuit with one arm of a bridge circuit so any change in resistance will unbalance the bridge and produce an electrical signal. Thus, when the sensing resistor is in a cold environment, positioned above a slowly rising pool of liquid nitrogen, its temperature will abruptly change when the liquid contacts the surface of the resistor, even though the temperature of the gas above the liquid and the liquid are identical. It is the increased coefficient of heat transfer with the liquid that increases the rate of heat loss from the resistor. The balance between heat in, due to the biasing current, and heat out, due to contact with gas or liquid, is abruptly upset. The consequent resistor temperature change produces a corresponding resistance change which produces a signal from the bridge circuit. This signal is used to terminate the flow of liquid nitrogen to prevent overflowing the pan.

Because the cryogenic apparatus of the present invention is used also at elevated temperatures (up to +350° F.), there is a danger of over heating level sensing resistor 22 causing its value to change slowly in time. This would necessitate frequent re-balancing of the bridge circuit. To avoid this instability a discriminator circuit may be provided to turn on the sensor resistor bias current only when the chamber temperature is sufficiently low (−200° F.) to avoid degradation of the resistor.

Figure 8:
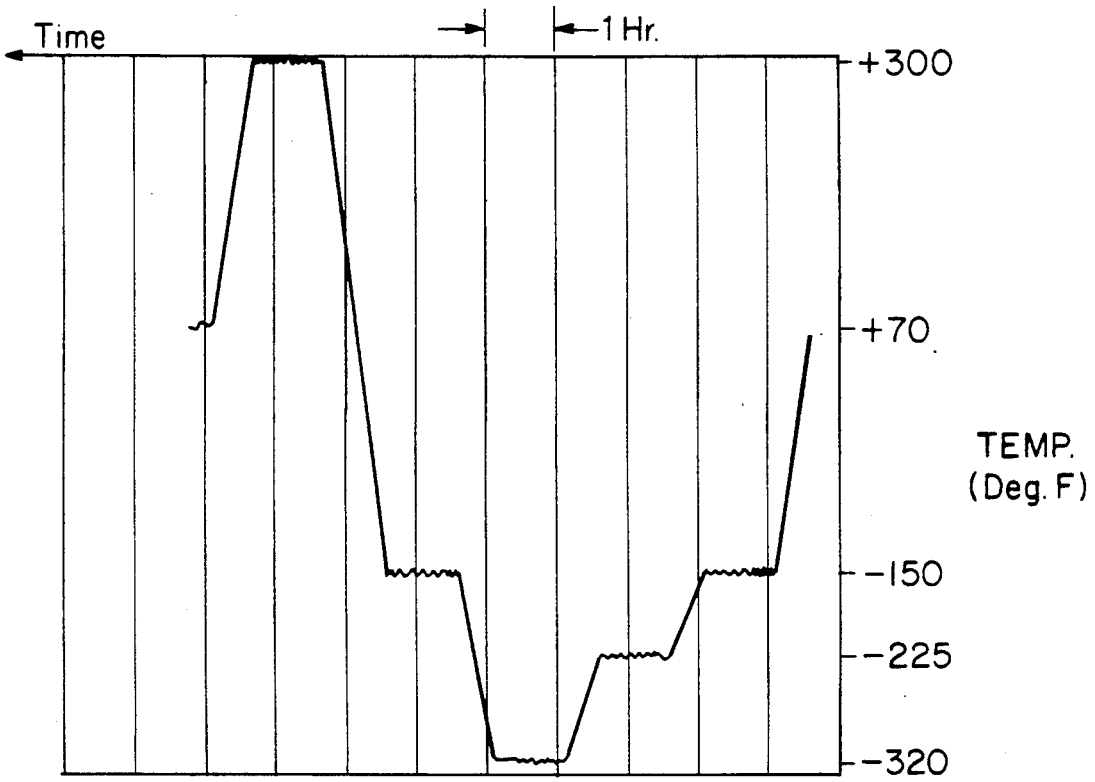
FIG. 8 is a time-temperature diagram showing processing cycles that might be performed for a payload.

FIG. 8 shows a time-temperature cycle of operation of the apparatus and is presented here as an illustration of the thermal capability of the apparatus.

Operation

Figure 4:
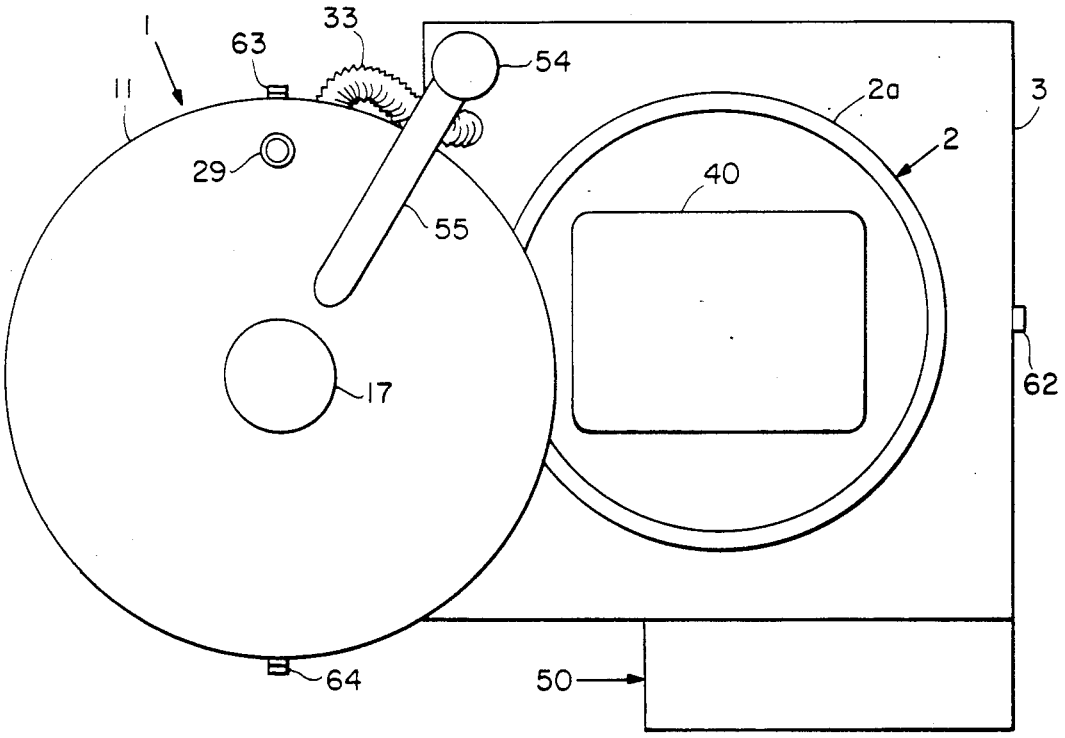
FIG. 4 is a top view of the apparatus with the power head lifted from and swung to the side of the chamber housing.

In operation, with power head 1 raised as shown in FIG. 2 and swung to one side as shown in FIG. 4, chamber 2 is loaded with payload 40 and the power head is swung back and lowered and clamped securely over the vacuum insulated "Dewar" chamber as shown in FIG. 1. The operator then operates the controls at 50 to program the schedule of temperature versus time (such as shown in FIG. 8) to carry out the treatment of the payload. When the program produces a command for cooling, solenoid valve 18 opens permitting liquid nitrogen to flow through the valve and into pan 21, via feed tube 19. The liquid nitrogen boils in the pan cooling it and the attached fins 13 and the gaseous nitrogen vapor, at substantially the same cryogenic temperature as the liquid, flows downward through the shaft opening 45 and openings 49 in the side of the pan into the chamber, cooling the payload Meanwhile, the rotating fan 14 provides a continuous flow of gas over fins 13. Driven in one direction, the fan draws gas up from the center of the chamber and compels it to flow against the fins, cooling the gas, which then flows down the sides of the chamber. Driven in the opposite direction. the fan compels the nitrogen gaseous vapor from the surface (the liquid-gas interface) of the liquid nitrogen 24 in the pan to flow down into the chamber. Thus, the fan controls the strength of gas and gaseous vapor convection currents between chamber 2 and heat exchanger 4 and can control the direction of those currents. The liquid nitrogen 24 contacts only the upper portion of the heat exchanger; it never touches the payload.

The liquid nitrogen level sensor, resistor 22, protrudes into the pan 21 and sets the maximum level of liquid nitrogen in the pan. For example, it may be positioned about a quarter inch from the bottom of the pan and so when it is contacted and partially covered by liquid nitrogen, a liquid level signal is generated automatically in control system 50 that inhibits valve 18 from opening. In the event that the control system calls for an increased rate of cooling toward the lowest temperature (the temperature of the liquid nitrogen) and would normally simply open valve 18 to achieve the rate, the level sensor will limit the flow to prevent filling the pan over the maximum and so avoid overfilling that might result in spilling liquid nitrogen onto the payload below.

When control system 50 calls for an increase in chamber temperature, it generates a heat signal that causes relay switch in the control system to close, feeding electric power to heater coil 14, via high temperature limit switch 25. Again convective flow provided by the fan provides transport of heat between the heater coil and the chamber and payload. High temperature limit switch 25 is mounted in the heat exchange fins as shown, above the heater coil and overrides the heat signal in the control system by simply turning off power to the heater coil (heater element) in the event of a malfunction or improper programming that causes the temperature at switch 25 to exceed a predetermined maximum safe operating limit of the apparatus, for example +375° F.

Control System

Figure 7:
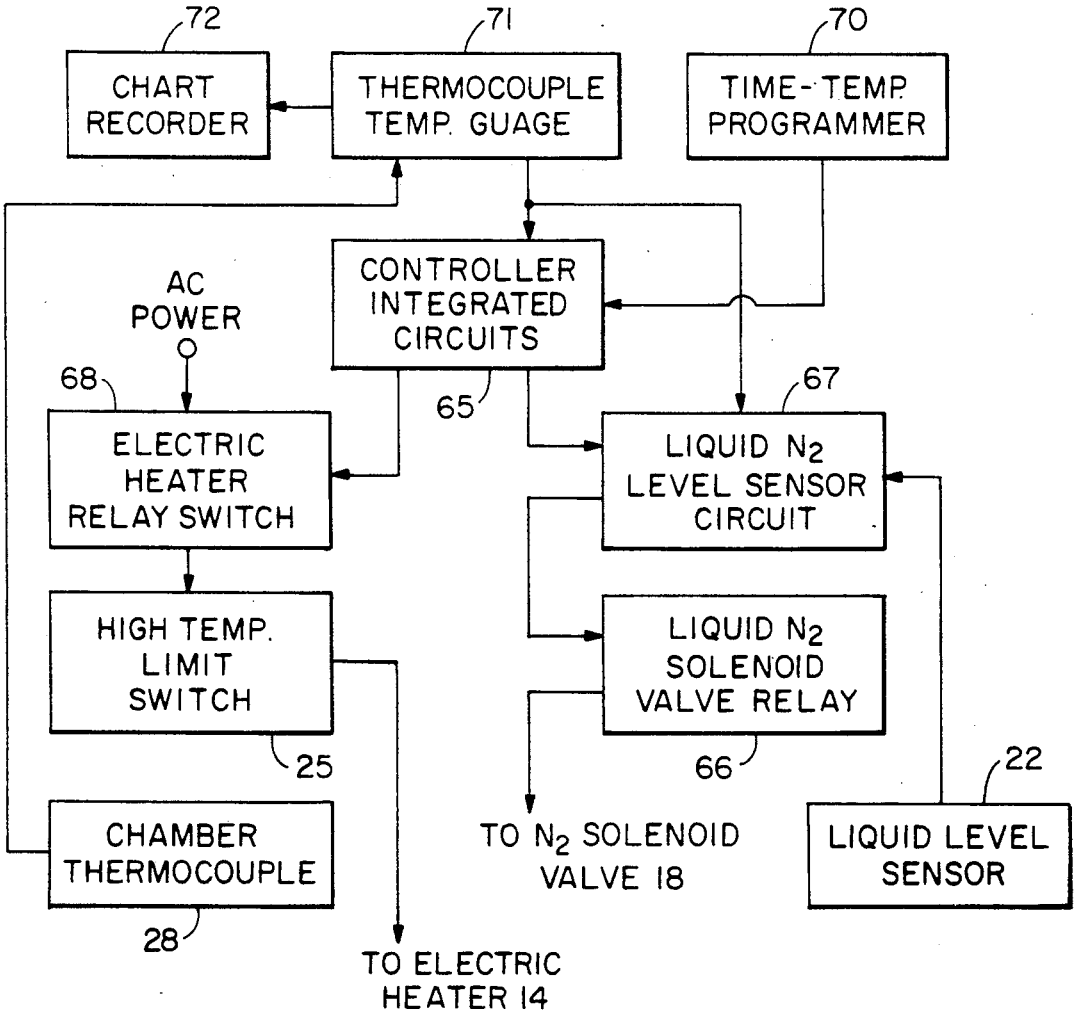
FIG. 7 is a schematic block diagram showing the principal electric circuits and devices for detecting parameters and controlling operation of the apparatus.

An electrical block diagram of control system 50 is shown in FIG. 7. The controller circuit 65 controls cooling and heating, inasmuch as it controls the liquid nitrogen flow control solenoid valve 18 and the heater coil 14. When controller 65 calls for cooling, it sends a "valve open" signal to solenoid valve 18 relay control 66, via liquid level sensor circuit 67, that initiates opening valve 18 allowing liquid nitrogen to flow into pan 21. Liquid nitrogen continues to flow into the pan until the liquid level sensor 22 impedance changes abruptly, as detected by circuit 66, whereupon the valve open signal from 67 to 66 is stopped. Following that, when sufficient liquid nitrogen has evaporated from the pan so that the level of liquid falls below sensor 22 and if cooling is still called for by controller 65, valve 18 opens again and more liquid nitrogen flows into the pan.

Meanwhile, or at another time, when controller 65 calls for heating during a heating cycle, or during a cooling cycle to reduce the cooling rate, it sends a "heat" signal to electric heater relay 68 that feeds AC electric power to heater coil 14, via high temperature limit switch 25 and if that switch is closed because the high temperature limit has not been reached, the AC power is fed to the coil. When the heat exchanger temperature at the location of switch 25 exceeds a predetermined limit of, for example +300° F., switch 25 opens interrupting electric power to the coil.

Controller circuit 65 may be a microprocessor controlled integrated circuit system including firmware that stores the particular time-temperature program called for by an operator. The inputs to controller 65 include the operators input from time-temperature programmer 70 and the chamber temperature from thermocouple gauge circuit 71 that responds to the chamber thermocouple 28. Thermocouple gauge circuit 71 may also provide a chamber temperature signal to chart recorder 72, which provides the operator with a paper record or the process carried out on the payload.

Through practice of the techniques of the present invention, and utilization of the cryogenic chamber apparatus thereof, substantial improvements to a variety of payloads has been achieved with high reliability and repeatability.

The specification and drawings hereof set forth the preferred embodiments of the invention and although specific terms have been employed, they are used in a generic and descriptive sense only and not for purposes of limitation, the scope of the invention being defined in the following claims.

What is claimed is:

1. Apparatus for carrying out cryogenic temperature processing of a payload including items and/or materials, for example, to improve wear, abrasion, erosion or corrosion resistivity characteristics or, improve dimensional stability characteristics or improve mechinability or provide stress relief to said items and/or materials, comprising:

(a) a treatment chamber having sides and a bottom wall each constructed of a temperature insulating material connected to render said chamber liquid tight where said sides and bottom meet, (b) the top of said chamber being open to receive said items and/or materials into said chamber and placed near the bottom of said chamber, (c) a readily removeable top closure for said chamber, including a cryogenic liquid evaporator and a gas heat exchanger in intimate thermal contact therewith, (d) means for supplying a cryogenic liquid to said heat exchanger and (e) means for directing gas and gaseous vapor from said chamber to said heat exchanger, (f) whereby said gas is cooled by said heat exchanger and flows to said items and/or materials placed near the bottom of said chamber.

2. Apparatus as in claim 1 wherein, (a) said evaporator and heat exchanger includes an open cryogenic liquid holding vessel and (b) said cryogenic liquid evaporates from said open vessel reducing the temperature of said heat exchanger, (c) whereby the temperature of said gas and gaseous vapor from said chamber is reduced.

3. Apparatus as in claim 2 wherein, (a) said evaporated cryogenic liquid flows as a gaseous vapor to said chamber, (b) whereby a substantial part of said chamber gas and gaseous vapor is evaporated cryogenic liquid.

4. Apparatus as in claim 3 wherein, (a) said cryogenic liquid holding vessel provides a relatively large cryogenic liquid to vapor interface as compared to the volume of said cryogenic liquid held in said vessel.

5. Apparatus as in claim 4 wherein, (a) said cryogenic liquid storage vessel is located on the top side of said heat exchanger and (b) means are provided on the bottom of said heat exchanger for exchanging heat with said chamber gas and gaseous vapor.

6. Apparatus as in claim 4 wherein, (a) means are provided for detecting the depth of said cryogenic liquid in said vessel and producing a liquid level signal representative thereof and (b) said means for supplying cryogenic liquid to said heat exchanger is responsive to said liquid level signal.

7. Apparatus as in claim 6 wherein, (a) means are provided for detecting the temperature of said gas flowing to said items and/or materials placed in said chamber and producing a gas temperature signal representative thereof and (b) said means for supplying cryogenic liquid to said heat exchanger is responsive to said temperature signal as well as said liquid level signal.

8. Apparatus as in claim 4 wherein, (a) a fan is provided that compels gas and gaseous vapor to flow from said liquid to vapor interface, past the bottom of said heat exchanger to said chamber.

9. Apparatus as in claim 1 wherein, (a) a gas and gaseous vapor heater is provided in the gas flow path between said heat exchanger and said chamber, (b) whereby said gas and gaseous vapor flowing to said items and/or materials placed in said chamber is heated.

10. Apparatus as in claim 9 wherein, (a) means are provided for detecting the temperature of said as flowing to said items and/or materials placed in said chamber and producing a gas temperature signal representative thereof and (b) said means for supplying cryogenic liquid to said heat exchanger is responsive to said temperature signal.

11. Apparatus as in claim 10 wherein, (a) a controller device is provided for controlling said means for supplying cryogenic liquid to said heat exchanger, (b) said controller device is responsive to said liquid level signal and to said temperature signal and (c) said controller device also controls said heater.

12. Apparatus as in claim 9 wherein, (a) means are provided for detecting the temperature of said gas flowing to said items and/or materials placed in said chamber and producing a gas temperature signal representative thereof, (b) said means for supplying cryogenic liquid to said heat exchanger is responsive to said temperature signal and (c) said heater is responsive to said temperature signal.

13. Apparatus as in claim 1 wherein, (a) means are provided for detecting the temperature of said gas flowing to said items and/or materials placed in said chamber and producing a gas temperature signal representative thereof and (b) said means for supplying cryogenic liquid to said heat exchanger is responsive to said temperature signal.

14. Apparatus as in claim 13 wherein, (a) a controller device is provided for controlling said means for supplying cryogenic liquid to said heat exchanger and (b) said controller device is responsive to said liquid level signal and to said temperature signal.

15. In apparatus for carrying out cryogenic temperature processing of a payload of items and/or materials, the improvement comprising:

(a) a treatment chamber having sides and a bottom wall each constructed of a temperature insulating material connected to render said chamber liquid tight where said sides and bottom meet, (b) the top of said chamber being open to receive said items and/or materials into said chamber and placed near the bottom of said chamber, (c) a readily removeable top closure for said chamber, including a cryogenic liquid to gas heat exchanger, (d) said top closure being supported on a vertical pivotal axis and is moveable along said vertical pivotal axis, (e) whereby said top closure may be raised from the top of said chamber and pivoted laterally to one side of said vertical chamber axis for access to the top of said chamber.

16. The method of carrying out cryogenic temperature processing of a payload including items and/or materials to improve wear, abrasion, erosion or corrosion resistivity characteristics or, improve dimensional stability, or improve machinability, or provide stress relief to said items and/or materials, including the steps of:

(a) placing said items and/or materials into the open top of a chamber near the bottom of said chamber, (b) feeding cryogenic liquid into an open vessel on top of a liquid-to-gas heat exchanger located at the top of said chamber, whereby said cryogenic liquid evaporates from said vessel, (c) directing said evaporated cryogenic liquid as a gaseous vapor into said chamber top so that it flows down the chamber to said items and/or materials near the bottom thereof and (d) whereby said gas and gaseous vapor from said chamber is cooled by said heat exchanger and when so cooled descends to the bottom of said chamber cooling said items and/or materials near the bottom thereof.

17. The method as in claim 16, further including the step of:

(e) compelling gas and gaseous vapor from said chamber to flow to the bottom of said heat exchanger to cool said gas and gaseous vapors.

18. The method as in claim 16, further including the step of:

(f) heating said gas and gaseous vapor to control the rate of cooling of said payload items and/or materials.

* * * * *